US006483416B2

(12) United States Patent
Yu

(10) Patent No.: US 6,483,416 B2
(45) Date of Patent: Nov. 19, 2002

(54) OVERLOAD PROTECTION DEVICE OF A PRESS TYPE SWITCH

(76) Inventor: Tsung-Mou Yu, 4, Sublane 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 81 days.

(21) Appl. No.: 09/789,606

(22) Filed: Feb. 22, 2001

(65) Prior Publication Data

US 2002/0113683 A1 Aug. 22, 2002

(51) Int. Cl.[7] ..... H01H 71/16

(52) U.S. Cl. ..... 337/126; 337/66; 337/68; 337/59; 337/72

(58) Field of Search ..... 337/59, 66–68, 337/64, 69, 70, 72, 74–76, 113, 126, 140, 414, 347; 29/622

(56) References Cited

U.S. PATENT DOCUMENTS 4,167,720 A * 9/1979 Krasser ..... 337/350
4,513,275 A * 4/1985 Jullien ..... 335/164
4,814,738 A * 3/1989 Krasser et al. ..... 337/66
4,990,882 A * 2/1991 Peter ..... 337/57
5,064,977 A * 11/1991 Fierro ..... 200/293
5,451,729 A * 9/1995 Onderka et al. ..... 200/18
5,760,672 A * 6/1998 Wang ..... 337/66
5,786,742 A * 7/1998 Yin ..... 337/347
6,094,126 A * 7/2000 Sorenson ..... 337/112
6,121,868 A * 9/2000 Chiang ..... 333/112
6,154,116 A * 11/2000 Sorenson ..... 337/112
6,377,158 B1 * 4/2002 Yu ..... 337/112
6,377,159 B1 * 4/2002 Yu ..... 337/112

FOREIGN PATENT DOCUMENTS

FR 2766007 A1 * 1/1999 ..... H01H/13/14

* cited by examiner

*Primary Examiner*—Anatoly Vortman
(74) *Attorney, Agent, or Firm*—Rosenberg, Klein & Lee

(57) ABSTRACT

The present invention relates to an overload protection device of a press type switch in which the switch main body has slide grooves within the bouncing range of the free end of the conductive strip. The shape of the slide grooves is formed by a plurality of slide rails. A push-pull element is pivotably connected to the inside of the press button. A cross bar is fitted to the bottom of the push-pull element while both ends of the cross bar are disposed in the slide grooves. Accordingly, the push-pull element is able to change path and locating position in the slide grooves. Moreover, the conductive strip can be controlled in on/off-state by means of the force in different directions. Beside, the free end of the conductive strip is kept in an independent state so that the conductive strip is transformed into the off-state in case of overload. Consequently, the safety of the user can be ensured.

3 Claims, 15 Drawing Sheets

OVERLOAD PROTECTION DEVICE OF A PRESS TYPE SWITCH

BACKGROUND OF THE INVENTION

1. Field of the Invention

The present invention relates to an overload protection device of a press type switch, and more particularly to a press type switch in which a push-pull element controlling the switching of a conductive strip slides along a preset path of an 8-shaped slide groove. Accordingly, this switch has not only the function of on/off control, it can also enable the conductive strip to carry out an automatic disconnection in case of overload so that the safety of the user is ensured.

2. Description of the Prior Art

The types of switches are various. Commercially available switches like see-saw switch, press type switch, spring type switch, microswitch, etc. differ from one another in configuration which are designed to meet the using requirements and habits of the users. Regarding the technical features of the see-saw switch, the inventor of the present invention has disclosed a few previously approved cases so that it won't be described more hereinafter. The present invention is an improvement of the two-stage press switch. A conventional two-stage press switch, as shown in FIGS. 1 through 4, utilizes a two-stage press element 2 projecting above the housing 1 to move a push rod 21, thereby controlling the conductive strip 3 in a connection or disconnection state. The press element 2 includes a heart-shaped slide groove 22 at inner side thereof which has several slide rails of different height and a U-piece 23. The top of the U-piece 23 is pivotably connected to the housing I while the bottom thereof is situated in the slide groove 22. When the press element 2 is pressed downwards, the top of the slide groove 22 is engaged at bottom end of the U-piece 23, as shown in FIGS. 1 and 2. At this time, it shows the on-state. In case of overload of the conductive strip 3, the press element 2 can't be automatically escaped since it is located by the U-piece 23. In order to switch to the off-state shown in FIGS. 3 and 4, it should be manually done. Consequently, the conventional press type switch doesn't have the protection effect in case of overload.

SUMMARY OF THE INVENTION

It is a primary object of the present invention to provide an overload protection device of a press type switch in which the conductive strip is deformable in the contrary direction for an electric disconnection in case of overload so that the safety in use is attainable.

It is another object of the present invention to provide an overload protection device of a press type switch which can be used as a conventional on/off switch at ordinary times.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
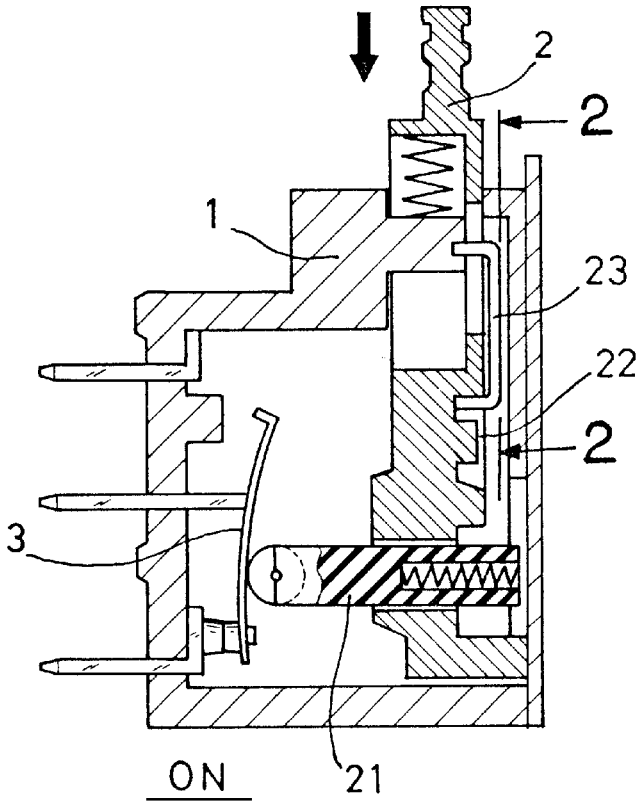
FIG.1 (PRIOR ART)
FIGS. 1 through 4 are schematic drawings of a conventional two-stage press type switch.
Figure 2:
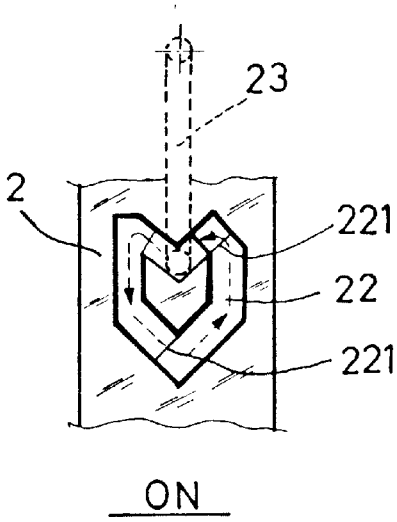
FIG.2 (PRIOR ART)
Figure 3:
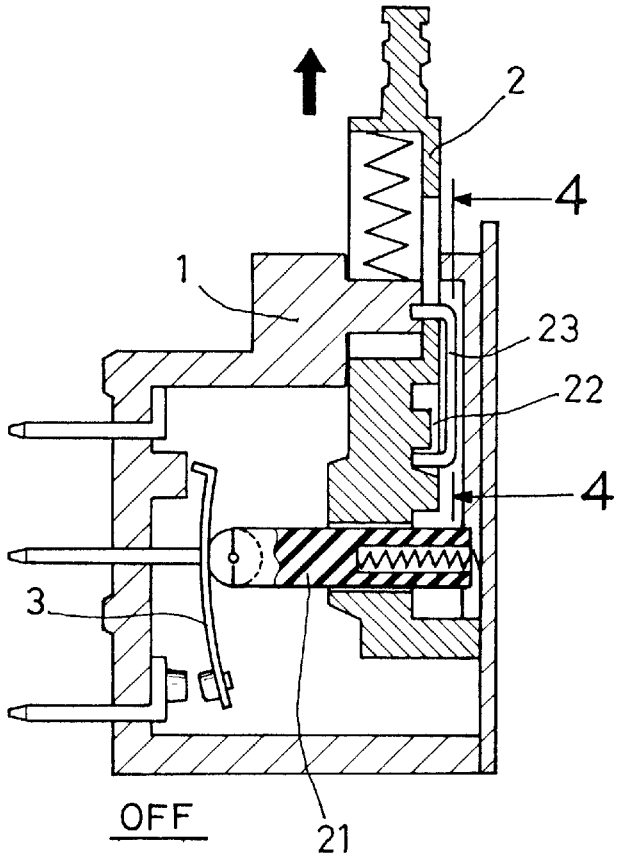
FIG. 3 (PRIOR ART)
Figure 4:
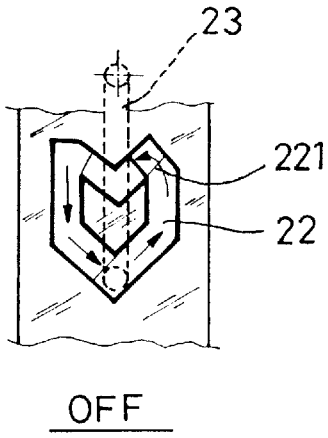
FIG. 4 (PRIOR ART)
Figure 5:
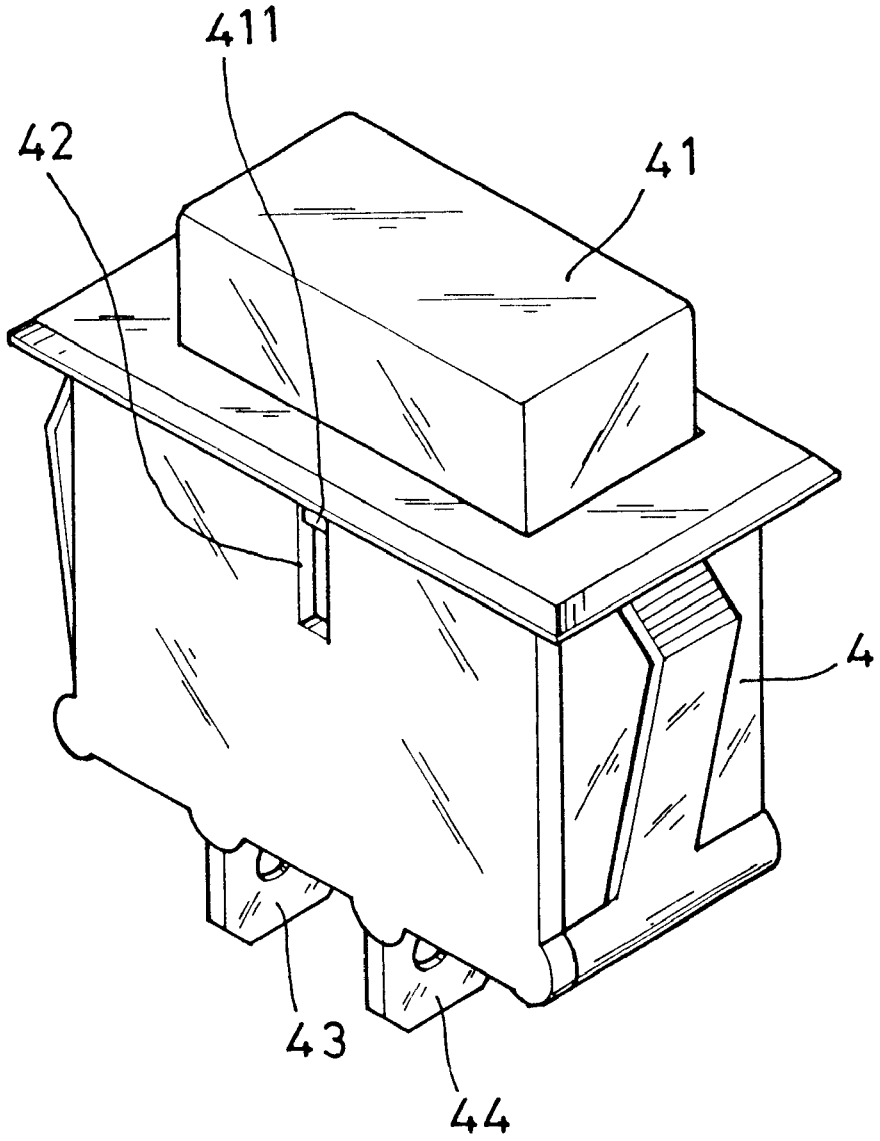
FIG. 5 is a perspective view of an applicable embodiment of the present invention.
Figure 6:
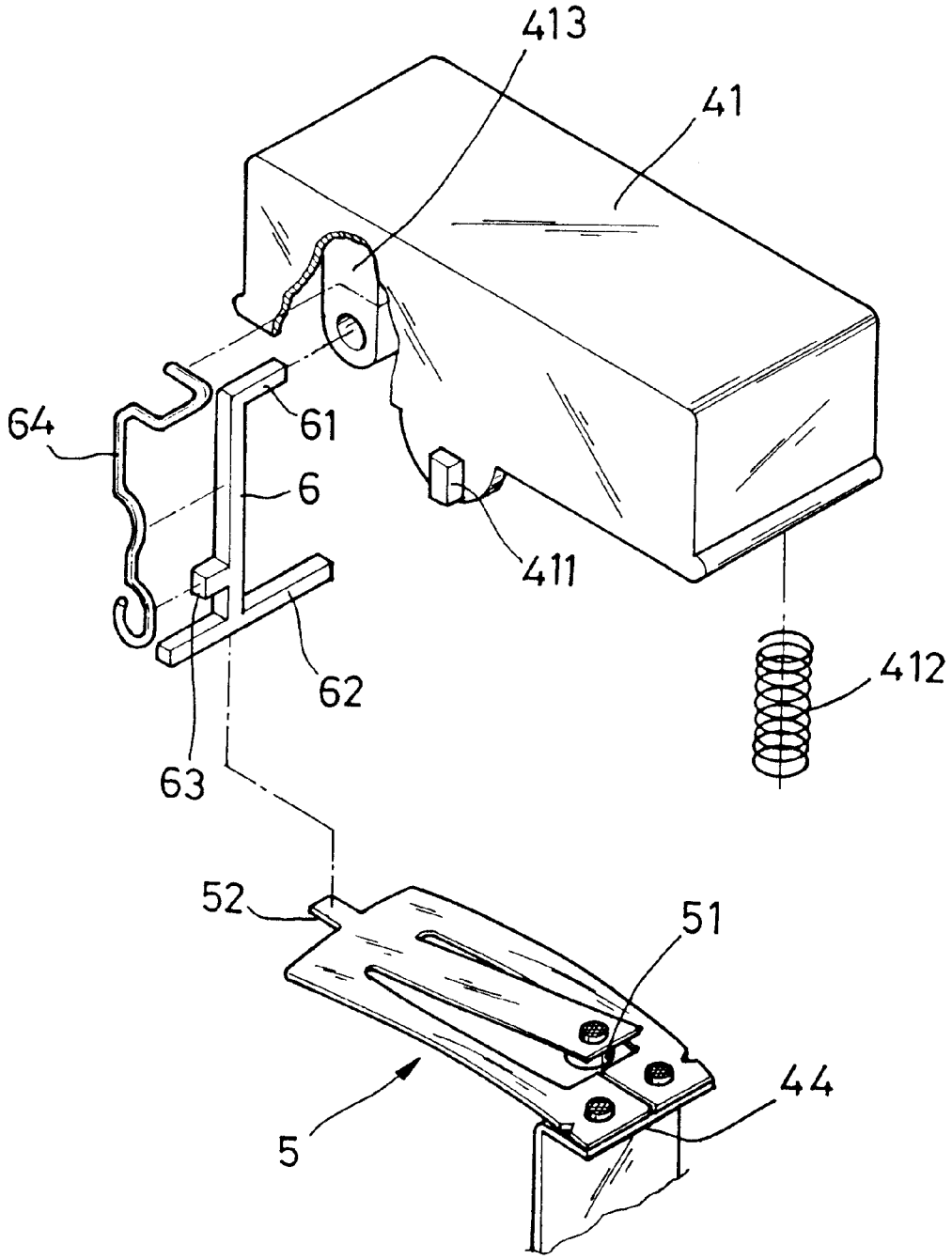
FIG. 6 is a perspective exploded view of the partial structure of the applicable embodiment of the present invention.

First of all, referring to FIGS. 5 through 8, the press type switch in accordance with the present invention includes a main body 4, at least two conductive plates 43, 44 and a push-pull element 6.

The main body 4 is formed as a hollow rectangular case. A press button 41 is installed at the top thereof, and a projection 411 is fitted to each of two sides of the press button 41 and slidable up and down in a longitudinal groove 42 of the main body 4. At least one resilient element 412 is disposed beneath the press button 41.

A first conductive plate 43 has a conductive boss 431 while a second conductive plate 44 is connected to a conductive strip 5 to whose bottom a conductive nodule 51 opposite to the conductive boss 431 of the first conductive plate 43 is fitted.

The push-pull element 6 has a top bar 61 pivotably connected to a projecting ear 413 at inner rim of the press button 41 while the bottom end thereof is able to push and pull the free end of the conductive strip 5, thereby forming a press type switch.

Figure 7:
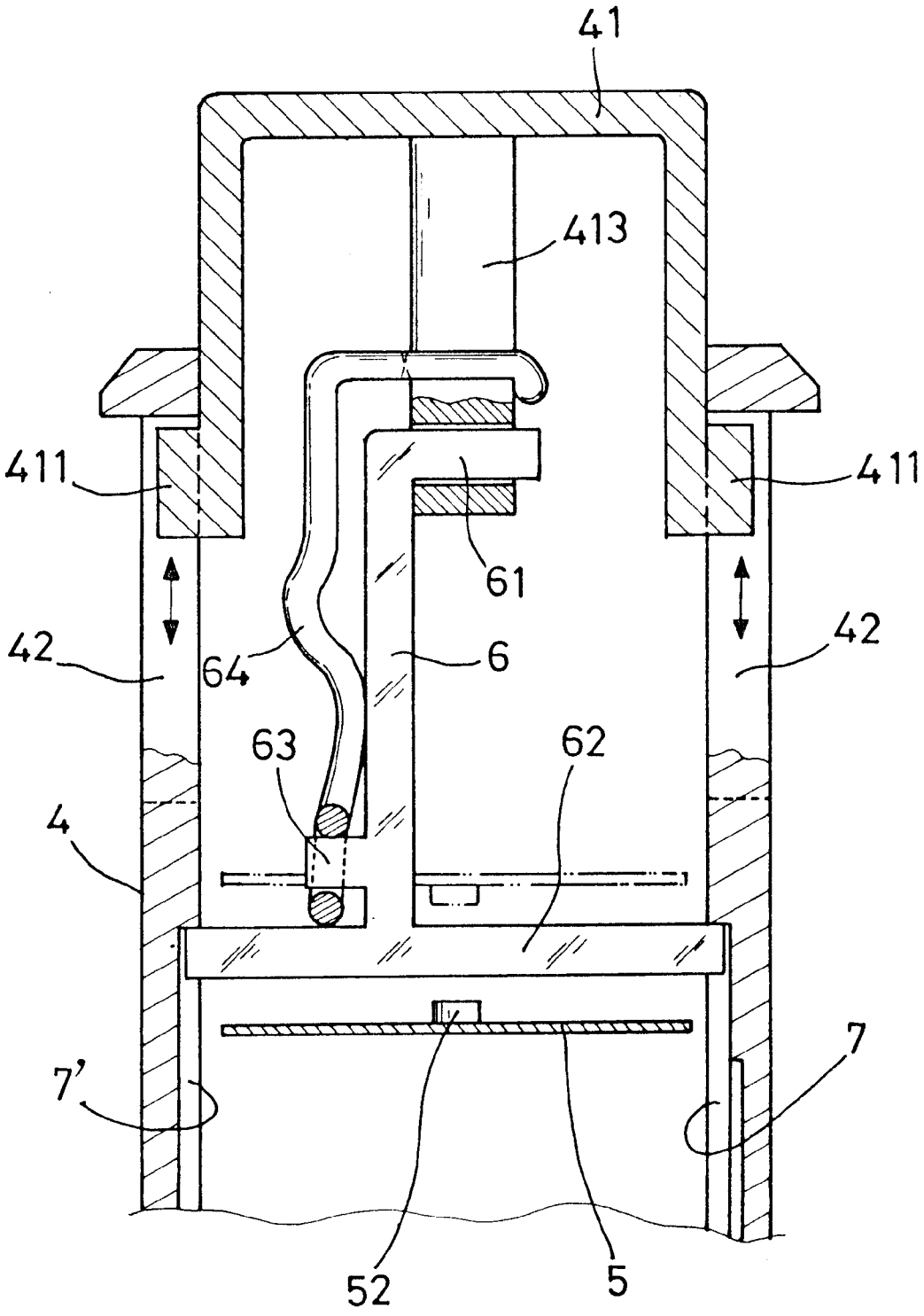
FIG. 7 is a sectional view of the partial structure of the applicable embodiment of the present invention.

In addition, two slide grooves 7, 7' are correspondingly arranged on the inner walls of the rear and front side of the main body 4 within the bouncing range of the free end of the conductive strip, as shown in FIGS. 7 and 7'. Each of the slide grooves 7, 7' is directed from the highest first locating position (A) downwards in a curved way to the lowest first turning position (A'), thereby forming a first slide rail 71, and then directed upwards in a curved way to a second locating position B, thereby forming a second slide rail 72. The second locating position (B) is situated lower than the first locating position (A) and at inner side thereof. And each of the slide grooves 7, 7' is directed upwards in a curved way to a second turning position (B') after intersecting the second slide rail 72, thereby forming a third slide rail 73, and then returns from the second turning position (B') upwards to the first locating position A, thereby forming a fourth slide rail 74 so that the slide groove in 8-shape is formed. Moreover, a stepped drop side 711, 721, 722, 731, 732, 741 is respectively formed at the connection and the cross positions between every two slide rails. The auxiliary slide groove 7' on inner wall of the front side of the main body 4 is the same in shape to the slide groove 7 on inner wall of the rear side thereof. The auxiliary slide groove 7' is only used to balance the other end of a cross bar 62 so that it doesn't need the stepped drop sides.

Furthermore, the conductive strip 5 has a projecting tongue 52 at front end thereof while the push-pull element 6 has an inverted T-shaped cross bar 62 at bottom thereof. Both ends of the cross bar 62 are respectively installed in the slide grooves 7, 7'. Besides, a resilient piece 64 is used to exert an inward resilient force on the slide groove at rear side of the main body 4. One end of the resilient piece 64 is hooked on a protrusion 63 at outer side of the push-pull element 6 while the other end thereof is hooked on the projecting ear 413 of the press button 41 or another objects, as shown in FIG. 7.

Figure 10:
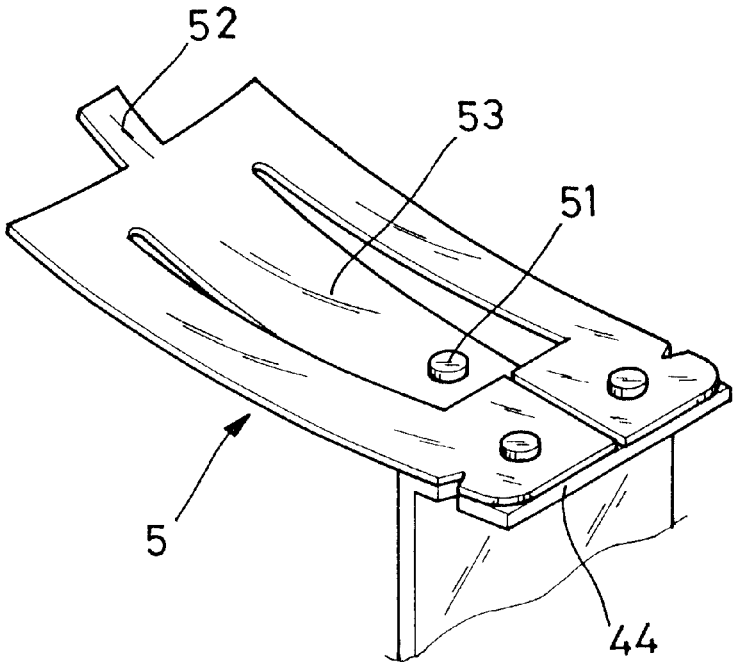
FIG. 10 is a perspective view of a conductive strip of the applicable embodiment of the present invention, showing a contact piece is downwards.
Figure 11:
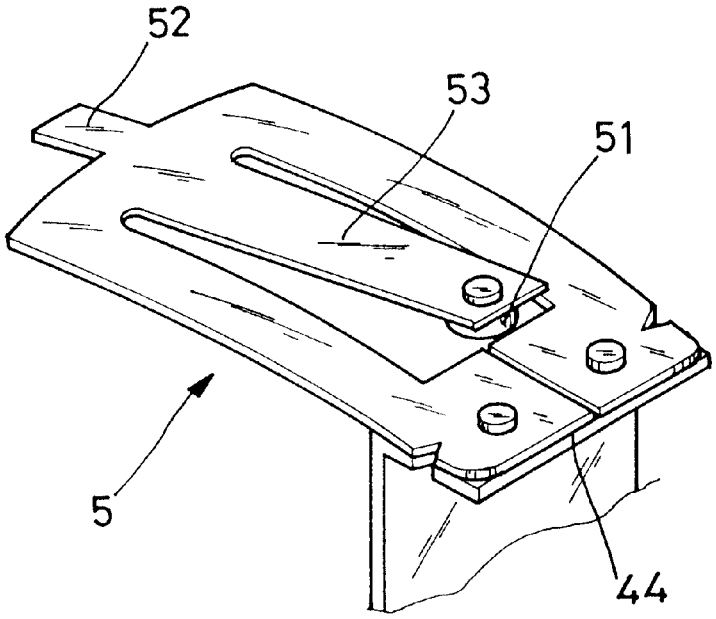
FIG. 11 is a perspective view of the conductive strip of the applicable embodiment of the present invention, showing a contact piece is upwards.

Referring to FIGS. 10 and 11, the conductive strip 5 disclosed in U.S. Pat No. 5,760,672 is an alloy plate extended with a contacting plate 53 at center thereof. The aforementioned conductive nodule 51 is mounted on the tail of the contacting plate 53. By means of the shrinking assembly of the tail of the conductive strip 5 to the second conductive plate 44, the free end of the conductive strip 5 is wider than the positioning end thereof, thereby forming a dished conductive strip 5 without the help of an additional spring member for pushing or pulling the projecting tongue 52 at free end of the conductive strip 5 at ordinary temperature and having bi-directional switching functions while the conductive strip 5 is transformable (from the shape in FIG. 10 to the shape in FIG. 11) in case of overload. Therefore, an open circuit is attained. The configuration of the conductive strip 5 has been detailed described in prior art so that no further description will be given hereinafter.

Figure 8:
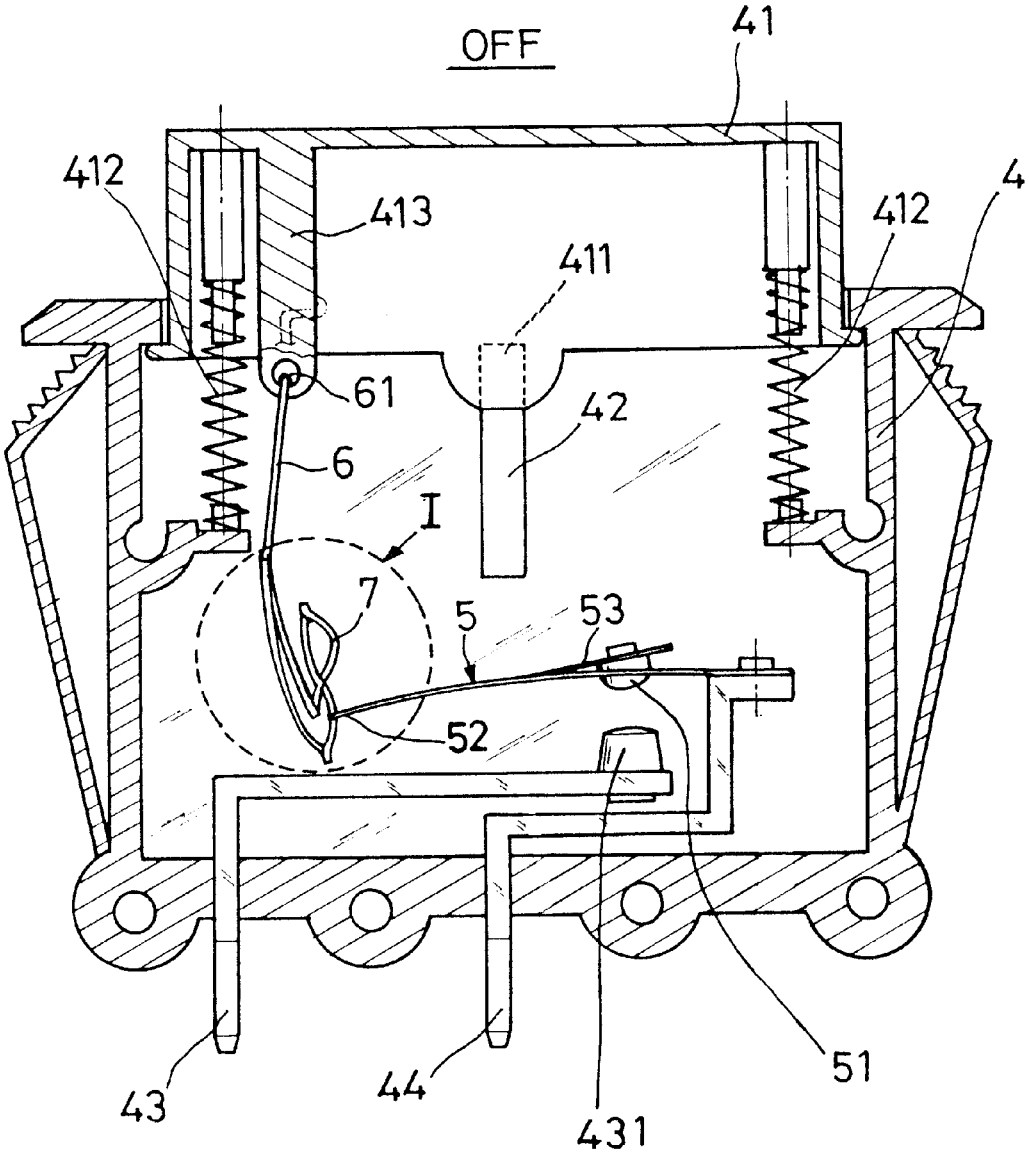
FIG. 8 is a section of the side view of the applicable embodiment of the present invention in off-state.
Figure 9:
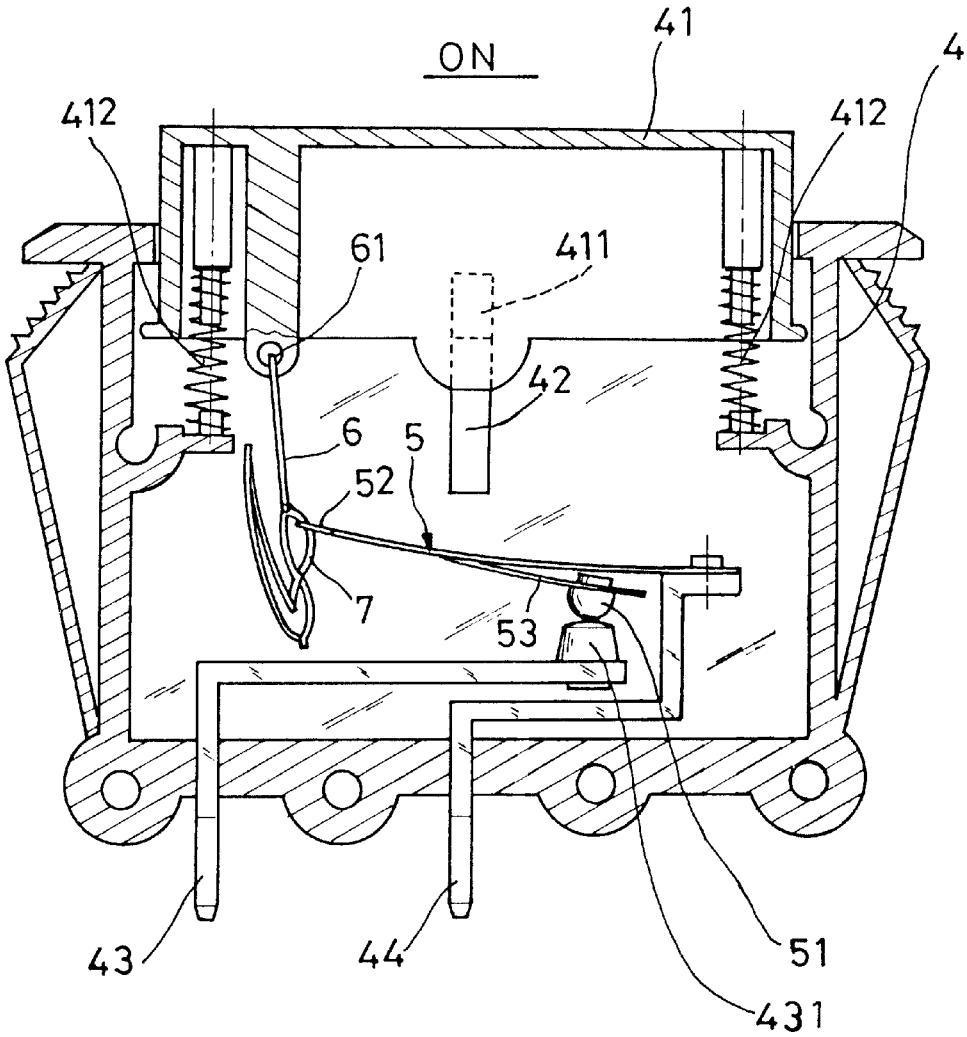
FIG. 9 is a section of the side view of the applicable embodiment of the present invention in on-state.
Figure 13:
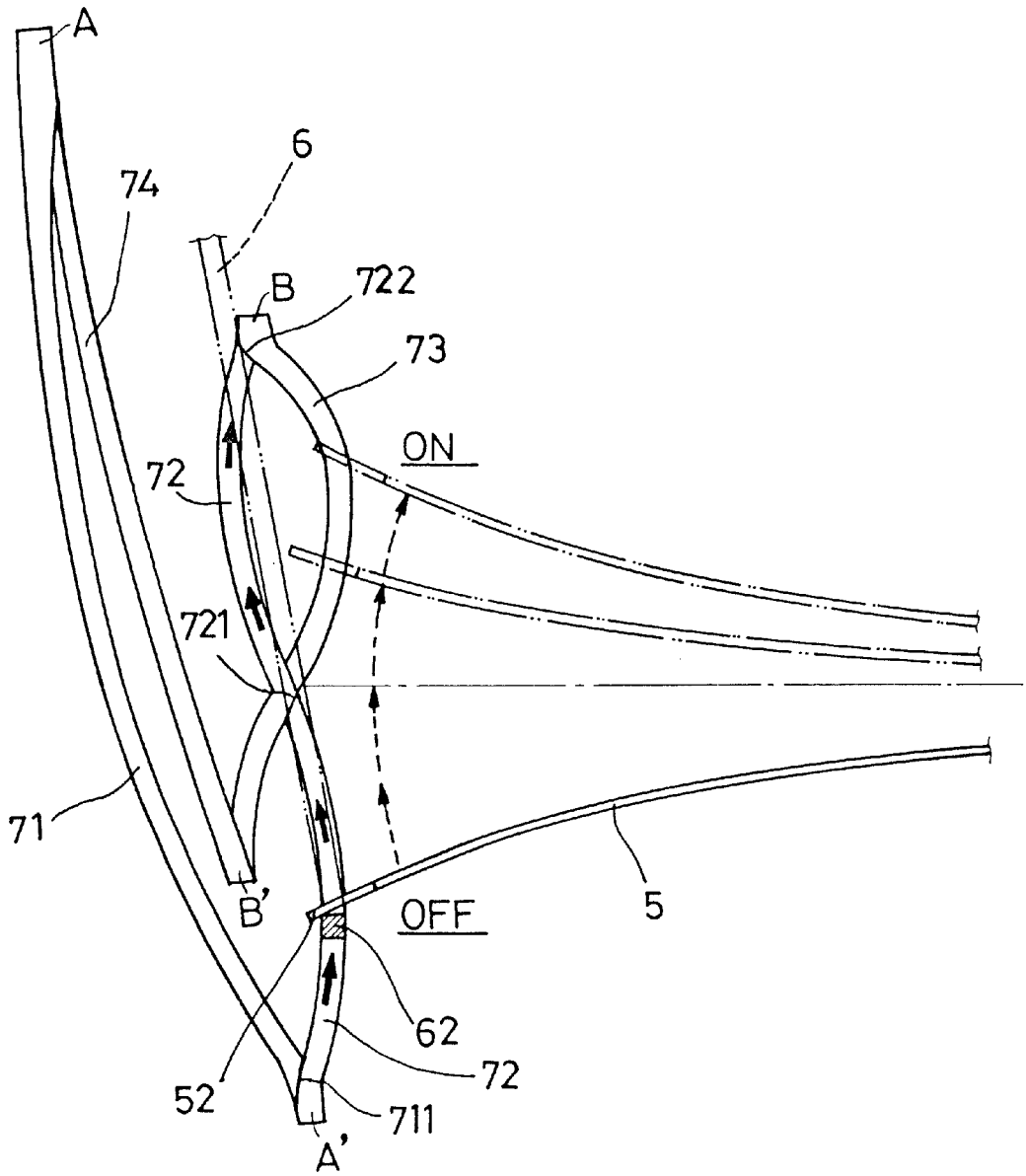
FIG. 13 is another enlarged view of part I in FIG. 8, showing the push-pull element slides from position (A) downwards to the lowest position (A') and is ready to slide upwards.

By means of the above-mentioned technical features, the functions of the present invention are described as follows:

Referring to FIGS. 8 and 10, when the front end of the conductive strip 5 is directed downwards and the contacting plate 53 is raised, the conductive nodule 51 at tail portion thereof is separated from the conductive boss 431 of the first conductive plate 43 in an open circuit. At this time, the press button 41 is situated at the highest position by means of an upward resilient force of the resilient element 412. Meanwhile, the push-pull element 6 rises such that both ends of the bottom cross bar 62 are situated at the first locating position (A) of the slide grooves 7, 7'. Accordingly, the open circuit is attained. In order to attain a closed circuit, press the press button 41 downwards while the push-pull element 6 is movable downwards therewith. Since both ends of the bottom cross bar 62 of the push-pull element 6, as shown in FIG. 7, are situated in the slide grooves 7, 7' on inner walls of the front and rear side of the main body 4, the cross bar 62 slides along the first slide rail 71 downwards. When the press button 41 is pressed to the bottom, the cross bar 62 is moved to the first turning position (A'). At this time, the press button 41 is bounced upward by the resilience of the resilient element 412 after releasing the press button 41, thereby moving the push-pull element 6 upward, as shown in FIG. 13. When the push-pull element 6 rises, the cross bar 62 between the front and rear slide grooves 7, 7' pulls the projecting tongue 52 at front end of the conductive strip 5 upwards so that the conductive strip 5 is transformed upwards, as shown in FIGS. 9 and 10. The tail portion of the contacting plate 53 is directed downwards so that the conductive nodule 51 is in contact with the contacting plate 53 to create the closed circuit.

Figure 14:
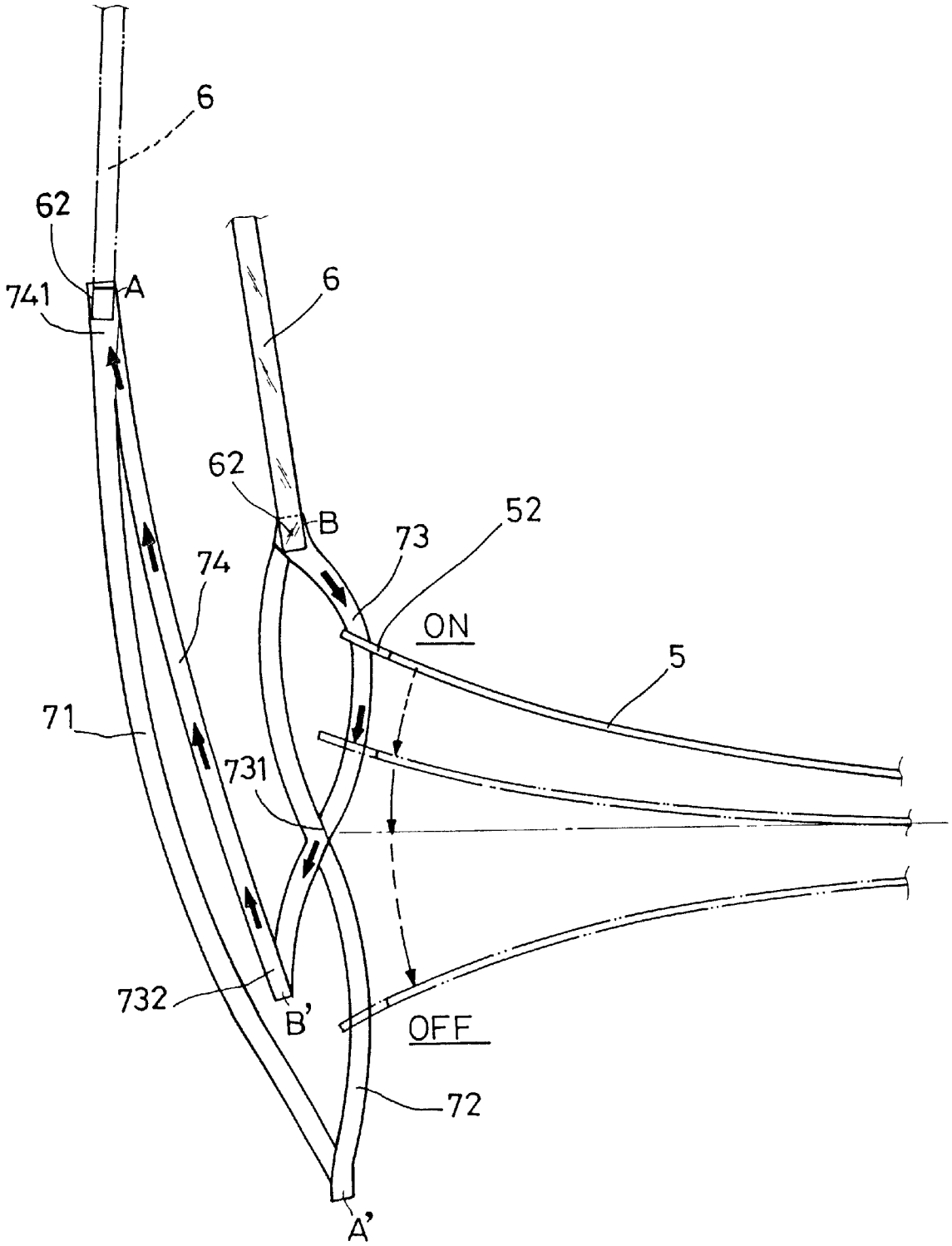
FIG. 14 is a further enlarged view of part I in FIG. 8, showing the push-pull element slides is situated at position (B) and ready to slide downwards to the position (B') and then upwards to return to position (A)

Again referring to FIG. 13, when the push-pull element 6 brings the conductive strip 5 to bounce upwards, the cross bar 62 slides along the second slide rail 72 upwards to the second locating position B, as shown in FIG. 14. At this time, the push-pull element 6 has changed its position and is situated above the conductive strip 5. This is very important. In a closed circuit, there are no other blocking objects beneath the conductive strip 5. In case of overload, the conductive strip 5 is transformable in the opposite direction into a convex shape by means of the shrinking assembly of the alloy plate, thereby creating an open circuit for ensuring the safety of the users.

Referring to FIG. 14, in case of no overload, the conductive strip 5 is situated at the position of the close circuit. In order to attain the open circuit, press the press button 41 so that the cross bar 62 at bottom of the push-pull element 6 slides along the third slide rail 73 downwards, thereby pushing the conductive strip 5 downwards. When the push-pull element 6 is pushed to the central position, it bounces to the off-state. Meanwhile, the cross bar 62 slides through the second slide rail 72 to fall into the second turning position B'. By means of the resilient force of the resilient element 412, the press button 41 rises to bring the push-pull element 6 back to the first locating position A. Therefore, the original open circuit is attained again.

Figure 12:
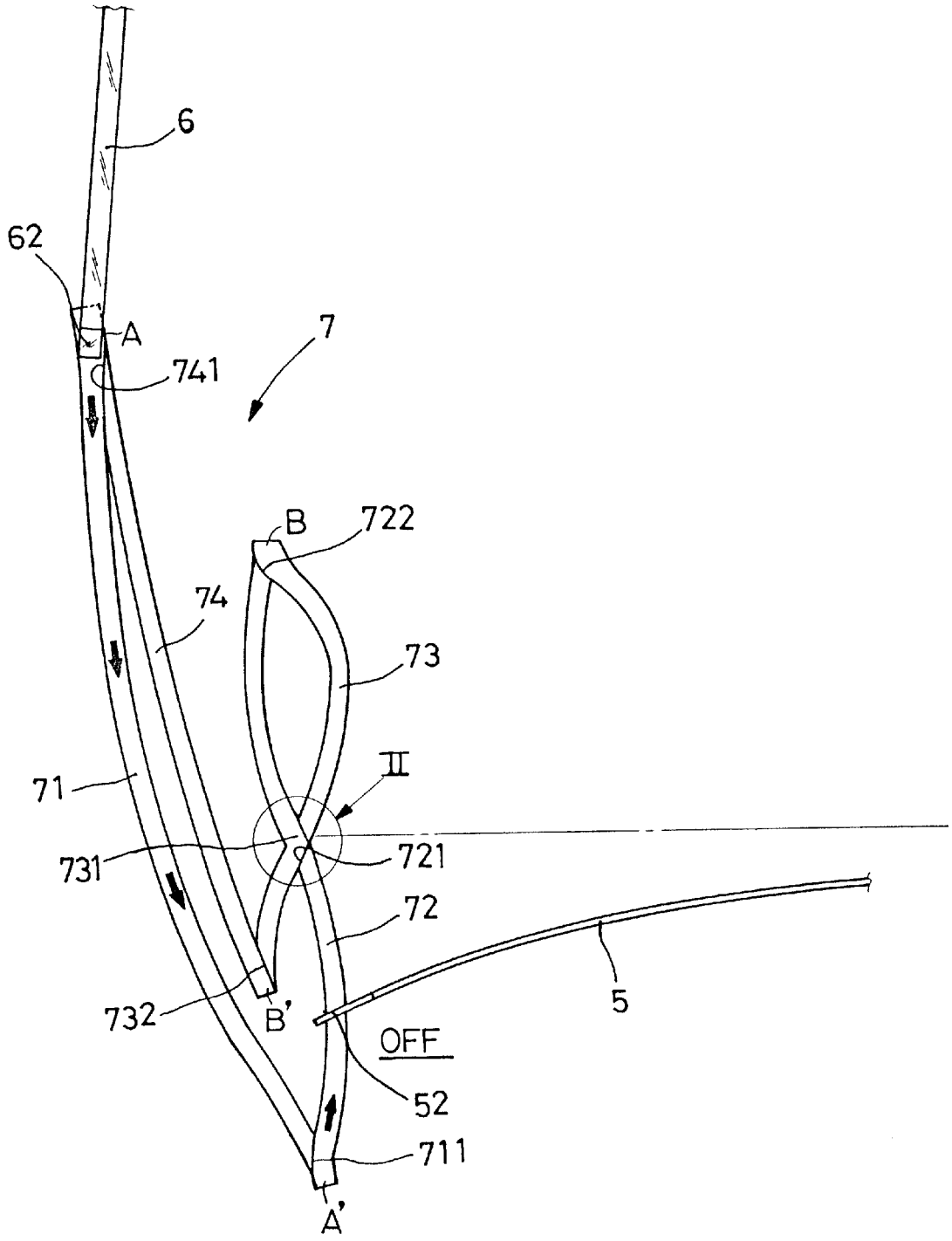
FIG. 12 is an enlarged view of part I in FIG. 8, showing the push-pull element is situated at position (A) of the slide groove.
Figure 15:
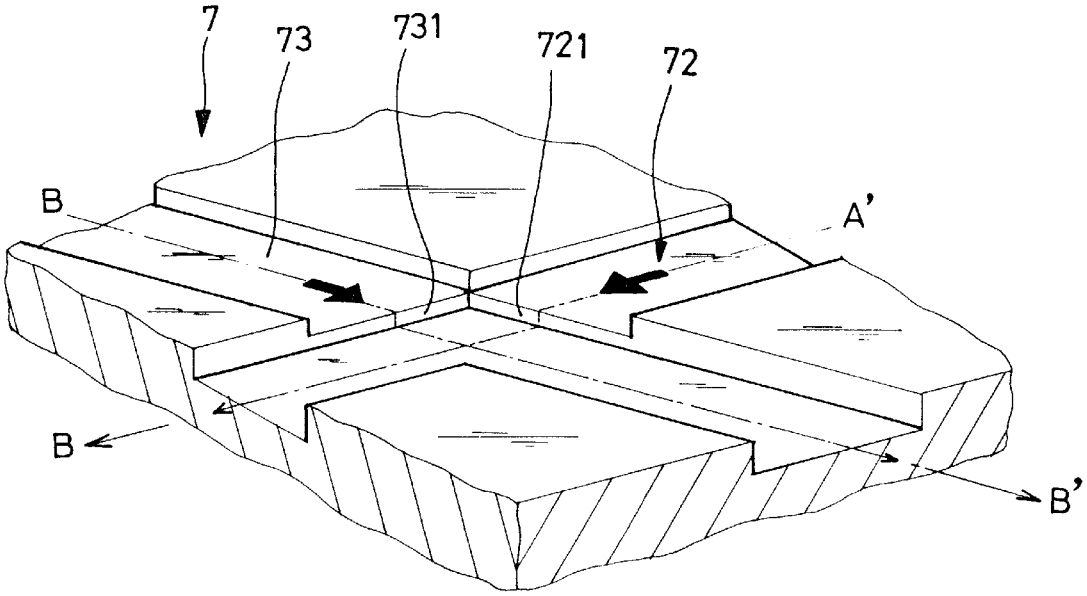
FIG. 15 is a perspective view of part II of the slide groove in FIG. 12.
Figure 16:
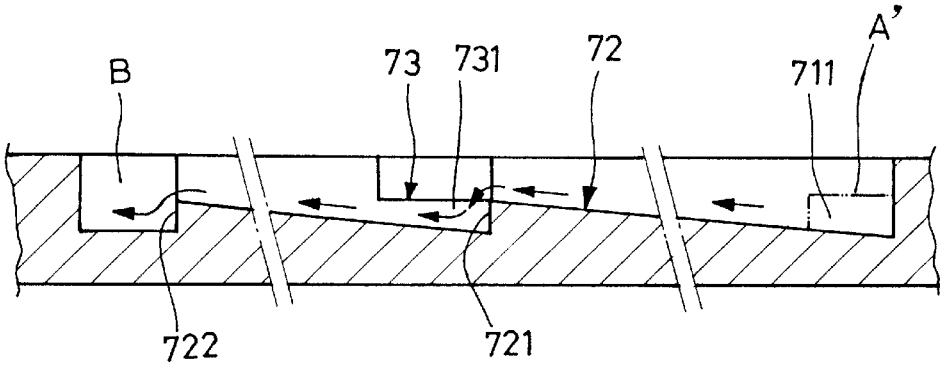
FIG. 16 is a side view of part II of the slide groove in FIG. 12.
Figure 17:
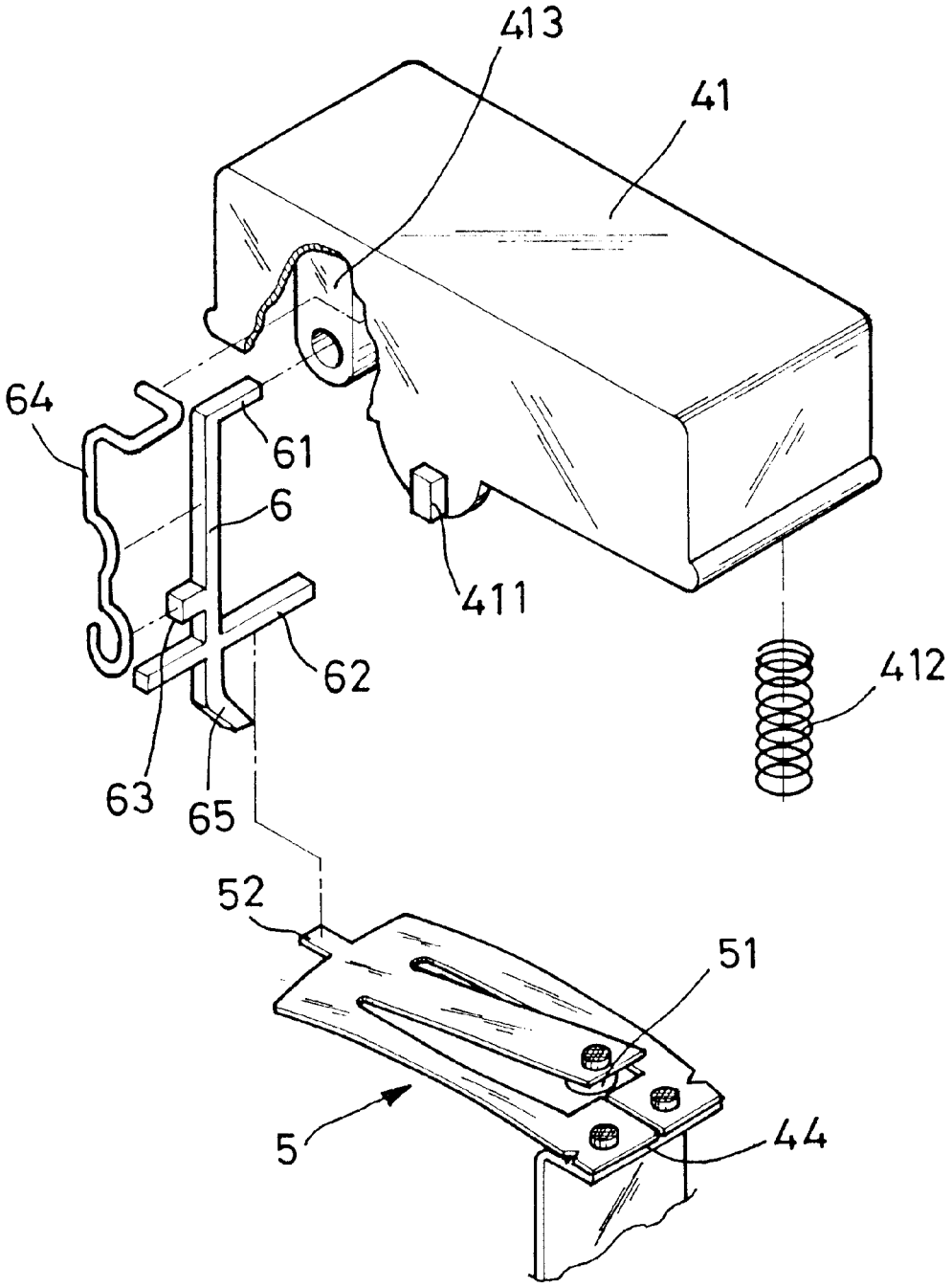
FIG. 17 is a perspective exploded view of the push-pull element and its relevant elements of another applicable embodiment of the present invention.
Figure 18:
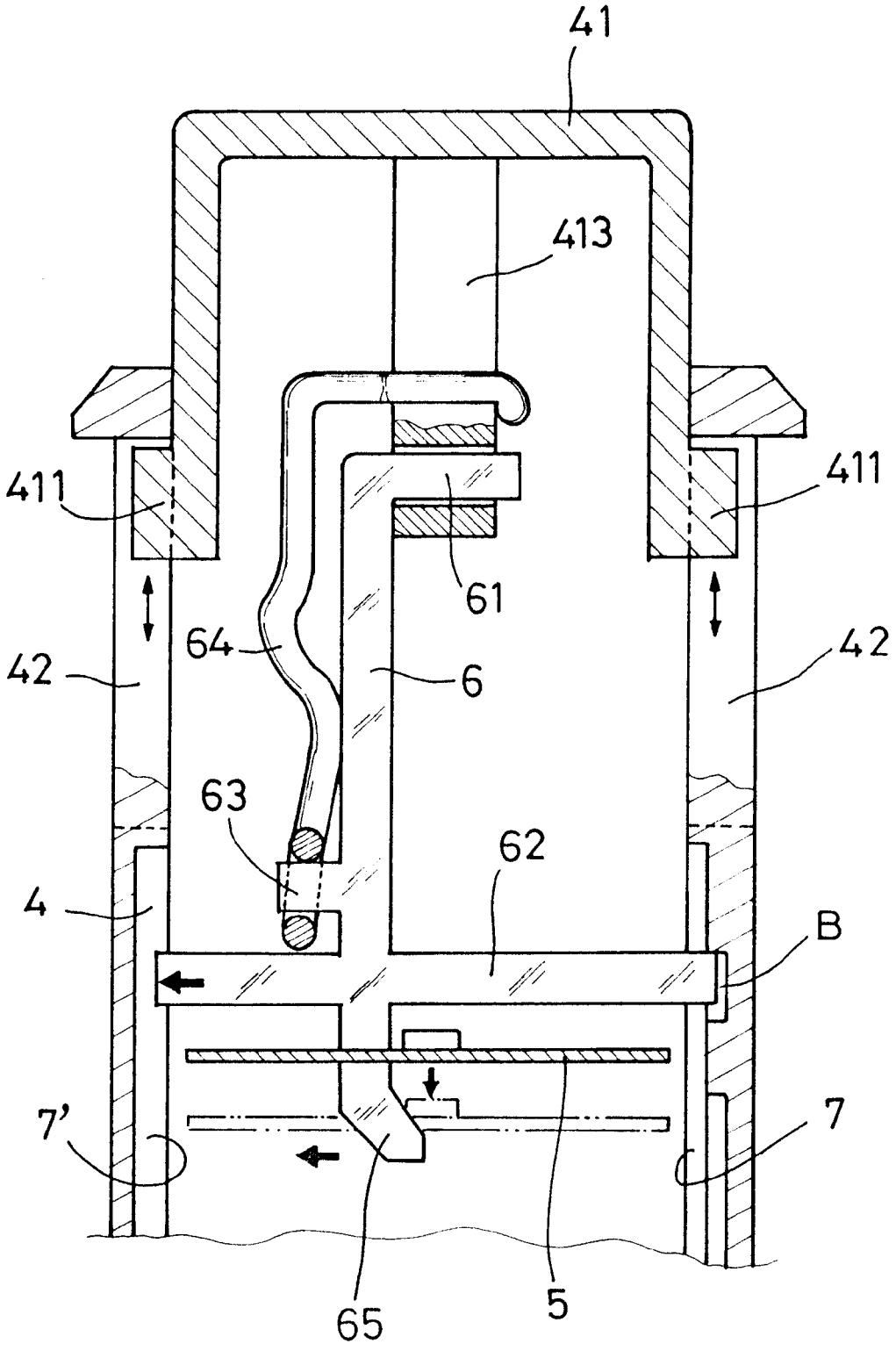
FIG. 18 is a sectional view of the partial structure of another applicable embodiment of the present invention.

That the push-pull element 6 is slidable along the slide rails 71, 72, 73, 74 in the slide groove 7 successively is completed on two pre-conditions. Firstly, a stepped drop side 711, 721, 722, 731, 732, 741 is respectively formed at the connection and the cross positions between every two slide rails, as shown in FIGS. 12, 15 and 16. Secondly, the cross bar 41 has always a resilient force in the direction of the rear slide groove 7 by means that the resilient piece 64, as shown in FIG. 7, is fitted to the outer side of the push-pull element 6. By means of these two features, the push-pull element 6 is able to slide along the preset path to reach the first locating position (A) and the second locating position B. Moreover, the push-pull element 6 can dodge the conductive strip 5 by means of the 8-shaped design of the curved crossed slide groove 7 so that the conductive strip 5 is freely transformable in case of overload without being blocked by any objects. Thus, the safety of the user can be ensured. In addition to the automatic disconnection function of the non-fuse switch, the present invention can be used as a conventional on/off switch at ordinary times. In other words, when the conductive strip 5 is transformed to the disconnection position in case of overload, the push-pull element 6 can be brought by the press button 41 from the second locating position (B) through the second turning position (B') back to the first locating position A, as shown in FIG. 14. The conductive strip 5 can be brought in the closed circuit by means of the action shown in FIG. 12.

Figures 19, 20:
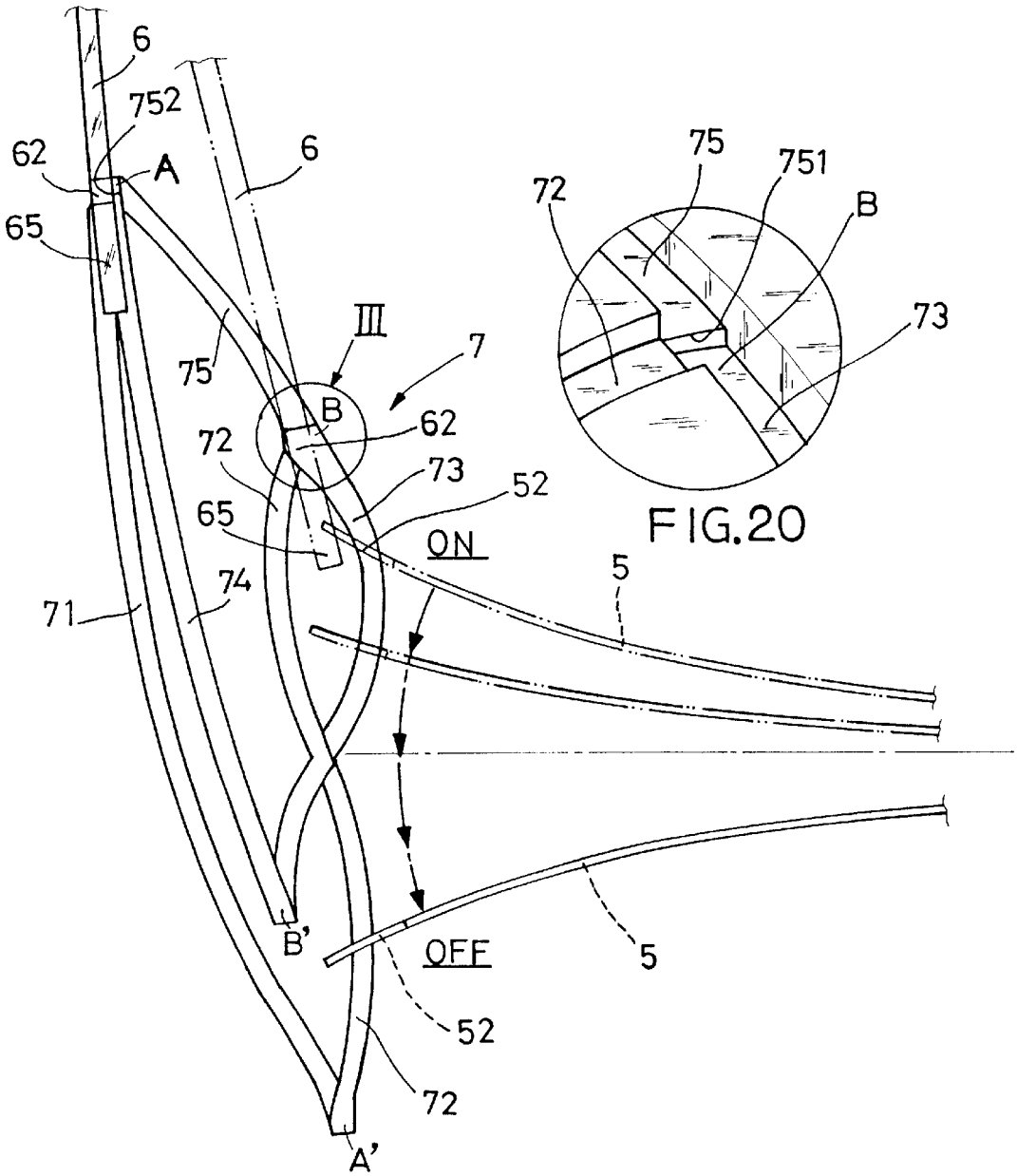
FIG. 19 is a schematic drawing of the slide groove of another applicable embodiment of the present invention.
FIG. 20 is a partially enlarged view of part III in FIG. 19.

In order for the push-pull element 6 can directly return from the second locating position (B) to the first locating position (A) after the conductive strip 5 is transformed in case of overload, the cross bar 62 of the push-pull element 6, as shown in FIGS. 17 through 20, is extended with a sloping arm 65 beneath while a fifth slide rail 75 is interposed between the first locating position (A) and the second locating position (B). In addition, the joint of the fifth slide rail 75 and the second locating position (B), as shown in FIG. 20, has a higher drop side 751 while the joint of the fifth slide rail 75 and the first locating position (A) has also a drop side 752. Accordingly, when the conductive strip 5 is transformed in contrary direction in case of overload, the downward displacement of the projecting tongue 52 touches the sloping arm 65 so that the push-pull element 6 displaces itself outwards. Therefore, the push-pull element 6 passes over the drop side 751 to slide from the second locating position (B) to the first locating position A. This design enables the press button 41 after automatic switching in case of overload to return to the original off-state. This embodiment is more progressive than the aforementioned.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An overload protection device of a press type switch comprising:

a main body formed as a hollow rectangular case, a press button being installed at the top thereof, at least one resilient element being disposed beneath said press button;

at least two conductive plates composed of a first and a second conductive plate, said first conductive plate having a conductive boss while said second conductive plate is connected to a conductive strip to whose bottom a conductive nodule opposite to said conductive boss of said first conductive plate is fitted;

a push-pull element being pivotably connected to said press button while the bottom end thereof is able to push and pull the free end of said conductive strip, thereby forming a press type switch;

wherein a slide groove consisting of a plurality of curved crossed slide rails is arranged on the inner wall of the rear side of said main body within the bouncing range of the free end of said conductive strip, and said slide groove is directed from the highest first locating position (A) downwards in a curved way to the lowest first turning position (A'), and then directed upwards in a curved way to a second locating position (B), and said second locating position (B) is situated lower than the first locating position (A), and then slide groove is directed upwards in a curved way to a second turning position (B') after intersecting said second slide rail, and then returns from the second turning position (B') upwards to the first locating position (A) so that said slide groove in 8-shape is formed, and a stepped drop side is respectively formed at the connection and the cross positions between every two slide rails; and wherein said push-pull element has a cross bar beneath, and the end thereof is disposed in said slide groove, and a resilient piece exerts a resilient force on said slide groove at rear side of said main body.

2. The overload protection device of a press type switch as claimed in claim 1, wherein said cross bar of said push-pull element is extended with a sloping arm beneath while another slide rail is interposed between the first locating position (A) and the second locating position (B), and wherein the joint of said slide rail and said second locating position (B) has a higher drop side while the joint of said slide rail and said first locating position (A) has also a drop side.

3. The overload protection device of a press type switch as claimed in claim 1, wherein a resilient piece is fitted to the outer side of said push-pull element, and one end of said resilient piece is hooked on a protrusion at outer side of said push-pull element while the other end thereof is hooked on a projecting ear of said press button.

* * * * *